US005324140A

United States Patent [19]

Lopez et al.

[11] Patent Number: 5,324,140

[45] Date of Patent: Jun. 28, 1994

[54] FLEXIBLE SUBMERSIBLE COMPARTMENT

[76] Inventors: Jose De Jesus F. S. Lopez, Reforma 615 Lomas, Mexico DF, 11,000; Vincente R. P. Vazquez, P.O. Box 269, Cuidad Del Carmen 024100; Jose A. A. C. Yamin, Pensilvania No. 20-201, Mexico DF, 07810, all of Mexico

[21] Appl. No.: 853,393

[22] Filed: Mar. 17, 1992

[51] Int. Cl.[5] ..... B63C 11/34

[52] U.S. Cl. ..... 405/188; 405/185

[58] Field of Search ..... 405/188, 211, 216, 185, 405/12-14, 189-194

[56] References Cited

U.S. PATENT DOCUMENTS

| | | | |
|---|---|---|---|
| 3,197,968 | 8/1965 | Castellanos | 405/12 X |
| 3,328,970 | 7/1967 | Giambelluca | 405/188 |
| 3,386,254 | 6/1968 | Connally | 405/188 |
| 3,466,880 | 9/1969 | Elliott | 405/190 |
| 3,837,171 | 9/1974 | Scurlock | 405/193 |
| 3,864,924 | 2/1975 | Piotin | 405/188 |
| 4,983,072 | 1/1991 | Bell | 405/216 |
| 4,991,996 | 2/1991 | Tate | 405/12 |

FOREIGN PATENT DOCUMENTS

| | | | |
|---|---|---|---|
| 2009290 | 6/1979 | United Kingdom | 405/193 |
| 2114636 | 8/1983 | United Kingdom | 405/188 |
| 8802718 | 4/1988 | World Int. Prop. O. | 405/191 |

*Primary Examiner*—Dennis L. Taylor

*Attorney, Agent, or Firm*—Leydig Voit & Mayer

[57] ABSTRACT

A flexible, submersible compartment for underwater work in dry conditions which is particularly suited for work on petroleum drilling structures. The flexible, submersible compartment includes a flexible bell of reinforced elastomeric material having an opening surrounded by a collar at its top portion. A rigid platform-brace having a contractible outer ring is located beneath and attached to the flexible bell. The platform-brace also includes an inner ring which can be secured to a submerged portion of the petroleum drilling structure. In the event of contact with a rigid obstacle, the flexible bell adapts to the shape of the obstacle while the platform-brace contracts.

31 Claims, 13 Drawing Sheets

FLEXIBLE SUBMERSIBLE COMPARTMENT

TECHNICAL FIELD

This invention generally relates to a submersible compartment suitable for housing a user. More particularly, this invention relates to a submersible compartment which facilitates repair and maintenance of submerged structures.

BACKGROUND OF THE INVENTION

The need to perform operations of assembly, maintenance and/or repair on structures located under water is well documented. A variety of equipment has been developed to help facilitate such operations. Currently, various devices allowing submarine work to be performed in a dry environment are known. These known devices are generally complicated in design, difficult to transport, and costly to manufacture. Moreover, the known devices are constructed with rigid materials. This provides a significant impediment to their use in areas where there are obstacles or irregularities in the work space. A particularly acute problem is presented when structure that is to be repaired is located in places of limited space or where equipment parts or components impede the placement or installation of known rigid devices. This condition frequently arises when performing operations on petroleum drilling platforms having legs that are closely spaced.

In addition, due to the rigid nature of the known devices and to the action of the ocean (currents and tides), considerable stresses are transmitted to the structure or tubing about which a given device is installed. Hence, normally use of these devices is limited to areas such as an ocean floor or to positions where the devices can remain horizontal.

SUMMARY OF THE INVENTION

In view of the foregoing, it is a principal object of the present invention to provide a flexible compartment for underwater work, particularly useful for working on structures, equipment, or tubing partially or totally submerged even when there are obstacles located proximate to structures, equipment, or tubings.

It is another object of this invention is to provide a flexible compartment that contracts without damage upon contact with an obstacle.

Still another object of this invention is to provide a flexible compartment which reduces the transmission of stresses to the structure or element about which it is installed.

Yet another object of this invention is to provide a flexible compartment in which interior environmental conditions such as water level, are effectively controlled.

An additional object of this invention is to provide a flexible compartment which can be used on both horizontal and inclined structures.

These and other objects are realized by a flexible, submersible compartment including a flexible bell having an opening at an upper portion. A collar is attached to the flexible bell at the opening for securing the flexible bell to a structural element upon which operations are to be performed. A contractible lower platform-brace is attached to the flexible bell so that when the flexible compartment comes into contact with a rigid obstacle, both the flexible bell and the lower platform-base are contracted.

Other objects and advantages of the present invention will be made evident by the following detailed description of the embodiments.

DETAILED DESCRIPTION OF THE INVENTION

Figure 1:
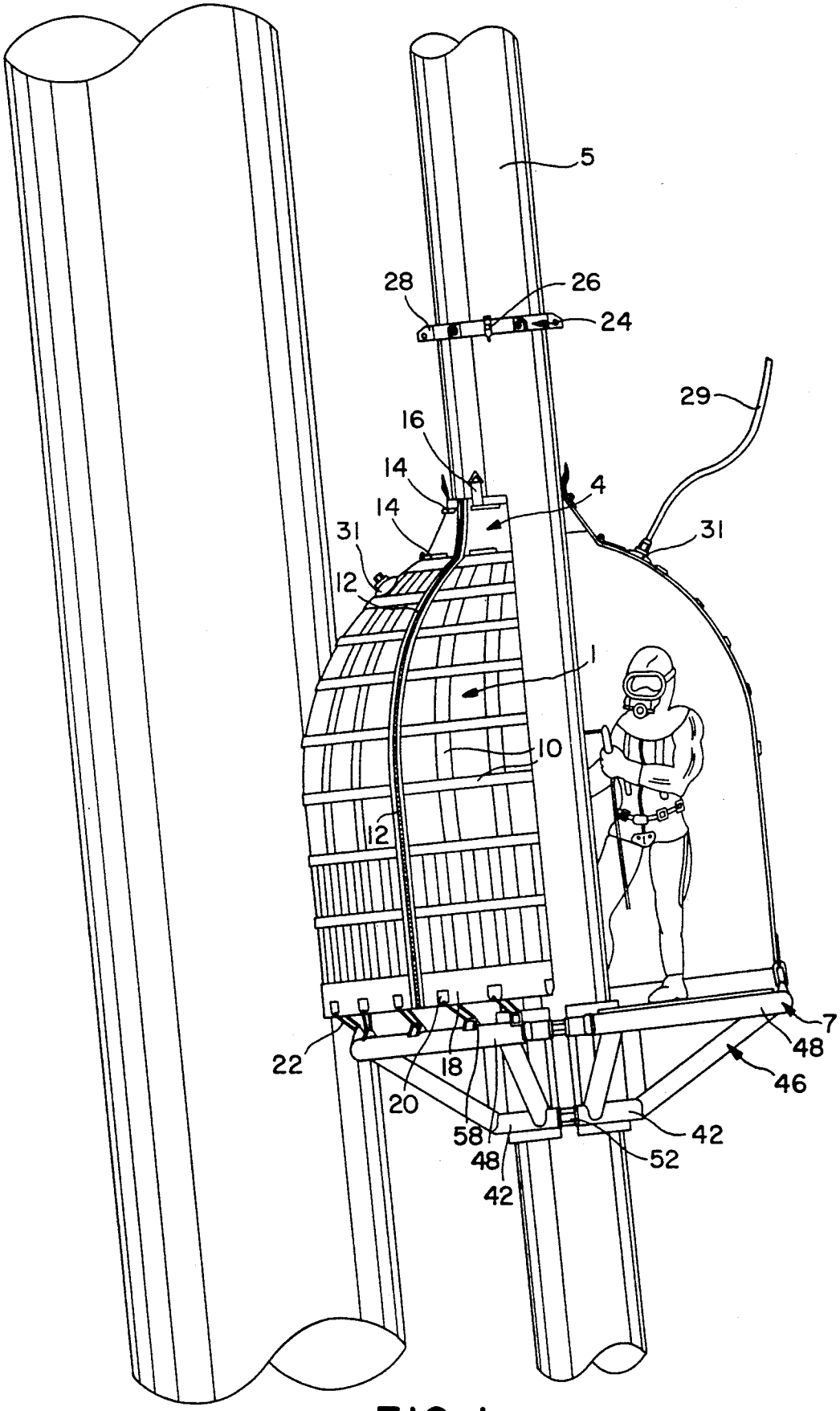
FIG. 1 is a side view showing the flexible compartment of the invention installed around vertical tubing of development platform.

Referring now to the previously described figures, the components constituting the flexible compartment of the present invention as well as their function and operation will be described. Turning to FIG. 1, generally, the present invention provides a flexible bell 1 which is substantially cylindrical with a hemispherical top portion, formed by a flexible, reinforced, impermeable fabric. An opening is provided at the center of the top portion, the opening being surrounded by a collar 4. As depicted in FIG. 1, the collar 4 attaches the flexible bell 1 to a mounting structure which, in this case, is a tubular member 5. A sealing element 6 (FIG. 6) is lodged between the collar 4 and the tubular member 5 to form a hermetic seal.

Figure 7:
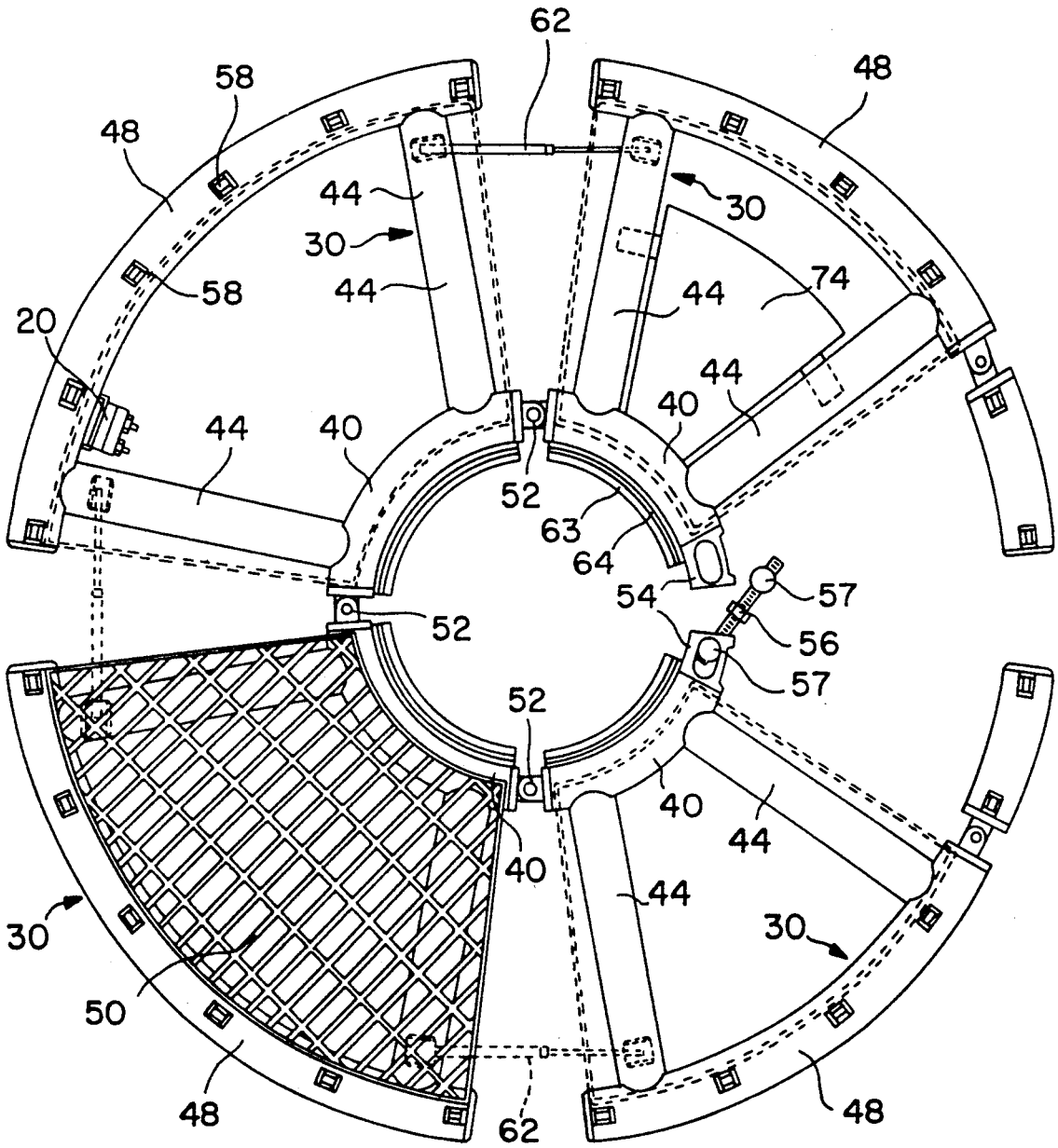
FIG. 7 is a top view of the lower platform-brace of the flexible compartment.
Figure 13:
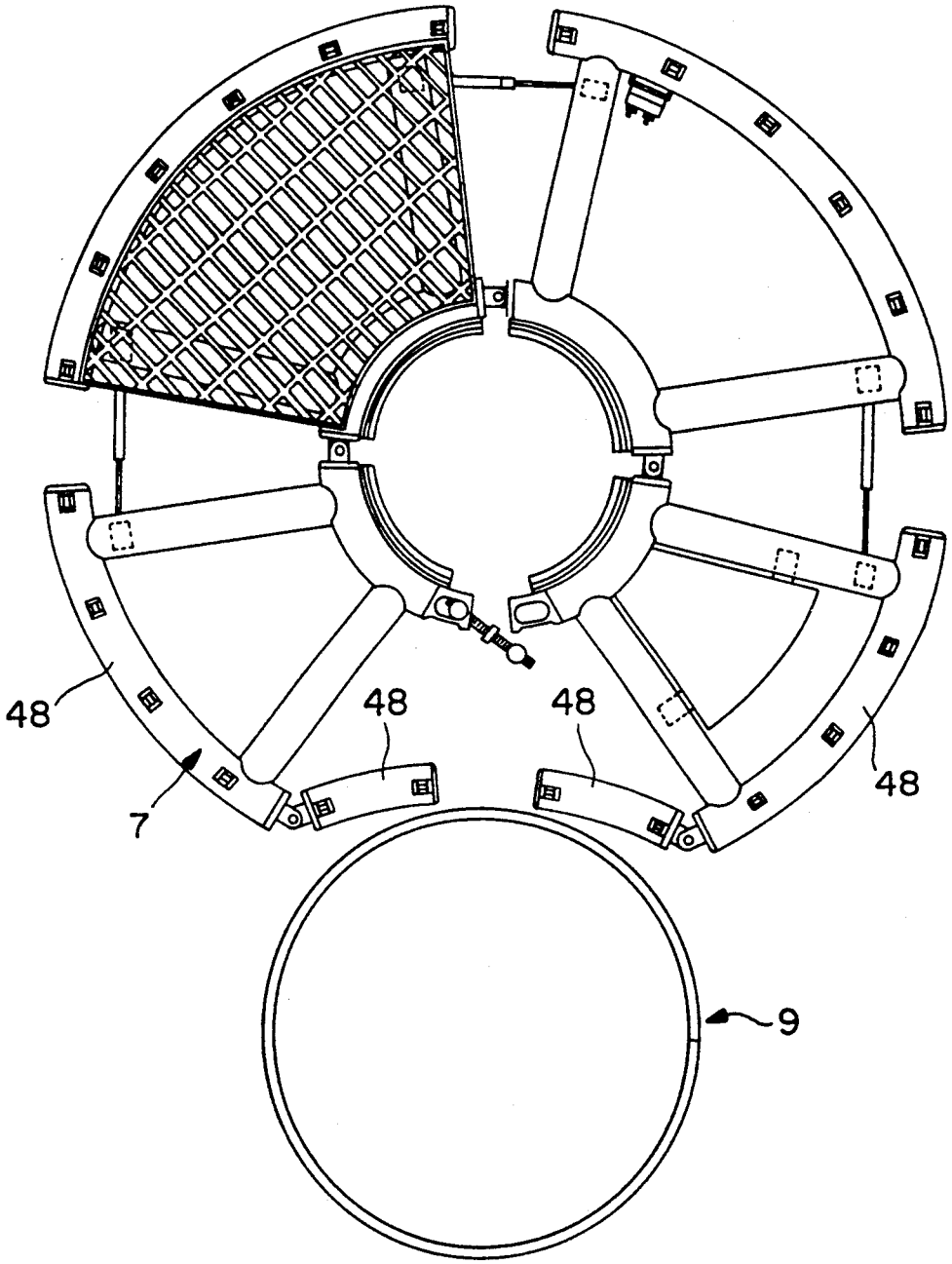
FIG. 13 is a top view of the platform-brace in its contracted position.
Figure 14:
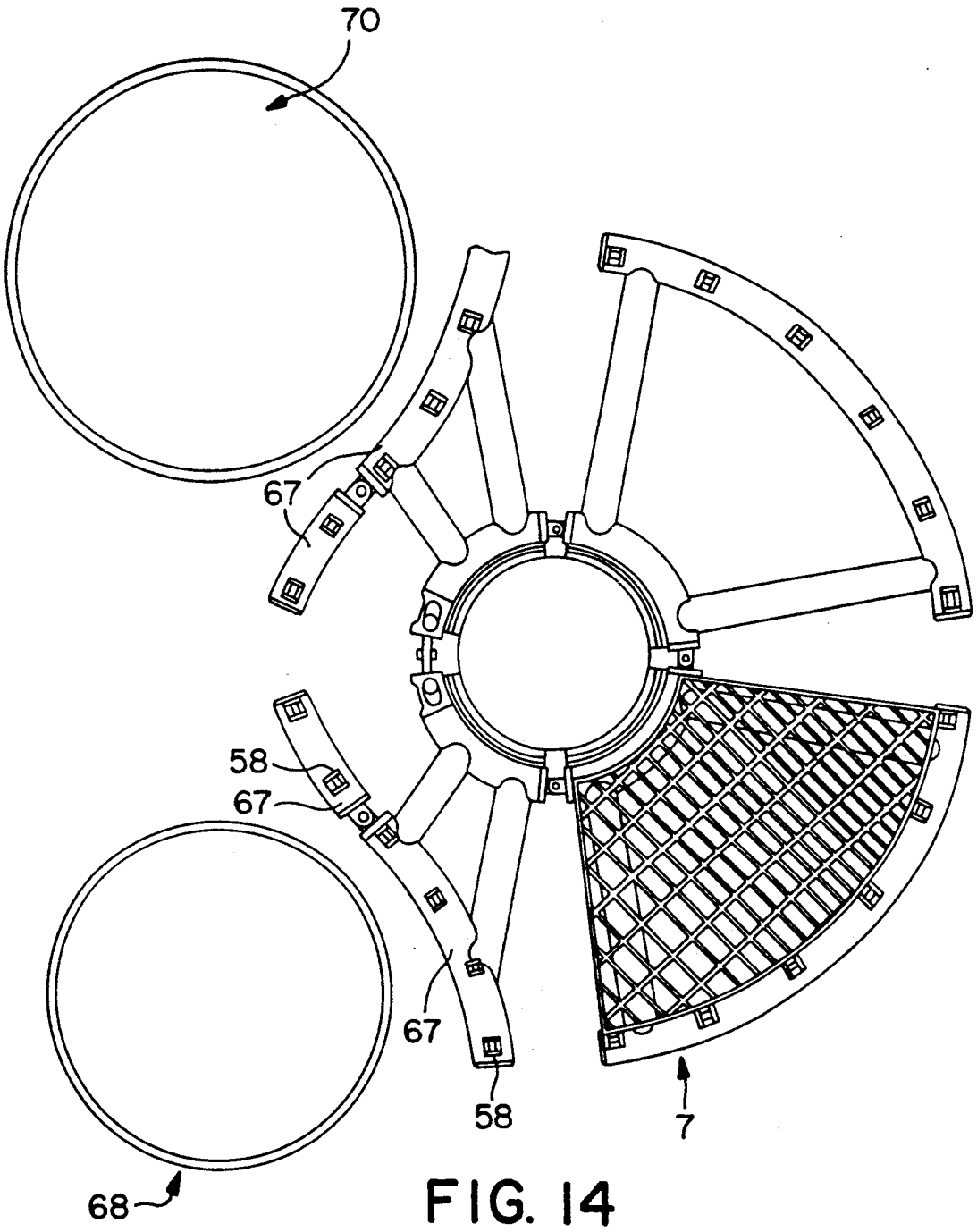
FIG. 14 is a top view of the platform-brace adjacent a pair of rigid obstacles.

In accordance with the invention, the flexible bell 1 is attached to and supported by an outer ring of a platform-brace 7 which, in turn, is attached to the tubular member 5 to provide for maneuverability in crowded spaces, the outer ring 7 is segmented as depicted in FIG. 7. Selected segments are pivotally interconnected so that upon contact with an obstacle 9, the segments contract (see FIGS. 13 and 14).

More specifically, in carrying out the invention, the flexible bell 1 is formed by a flexible fabric composed of several layers of material. In this embodiment, the flexible bell 1 fabric is composed of a fiber mesh 10 sandwiched between outer layers of elastomeric material. For illustration purposes the outline of the fiber mesh 10 is visible in the drawings although preferably the fiber mesh 10 forms an intermediate layer of the fabric forming the flexible bell 1.

The elastomer layers are preferably composed of neoprene, hypalon, or an elastomer such as polyvinylchloride (P.V.C.) or polyethylene. The fiber mesh 10 is preferably a mesh formed by intersecting vertical and longitudinal fibrous bands of nylon, aramid, or carbon fibers, or a similar reinforcing fibrous material. To minimize the likelihood of puncture yet to maintain a high degree of flexibility, the fabric forming the flexible bell 1 is preferable between ⅛" and ½" thick. The flexible bell 1 has one or more pair of closure mechanisms 12, preferably zippers, along its entire length or, where required, one superposed on the other. Once the zippers 12 are closed and the flexible bell 1 is inflated, the flexible bell 1 forms a unitary enclosure around the work area. As a result, the flexible bell 1 can be used on structures or tubings of any type, with no need to cut or dismantle them. In addition, when the flexible bell 1 is installed on a submerged tubing or structure, the mesh 10 which reinforces the flexible fabric which forms the bell distributes ascendant stresses created by the movements of the body of water.

When the flexible bell 1 is installed on a tubular member 5, the sealing element 6 is wedged between the tubular member 5 and the collar 4 thus forming a seal which keeps air or gas from leaving and/or water from entering the flexible bell 1. To provide structural reinforcement of the collar 4 and to enhance the integrity of the seal, steel cables 14 are included around the base and around the upper boundary of the collar 4. Fasteners 16 are disposed along the upper boundary of the collar 4 such that they cooperate with the steel cables 14 to facilitate installation. As depicted in FIG. 1, a conical collar 4 is employed in the preferred embodiment. However, the collar 4 can be cylindrical or any other shape that allows for the creation of an hermetic seal between the collar 4 and the tubular member 5.

Figure 5:
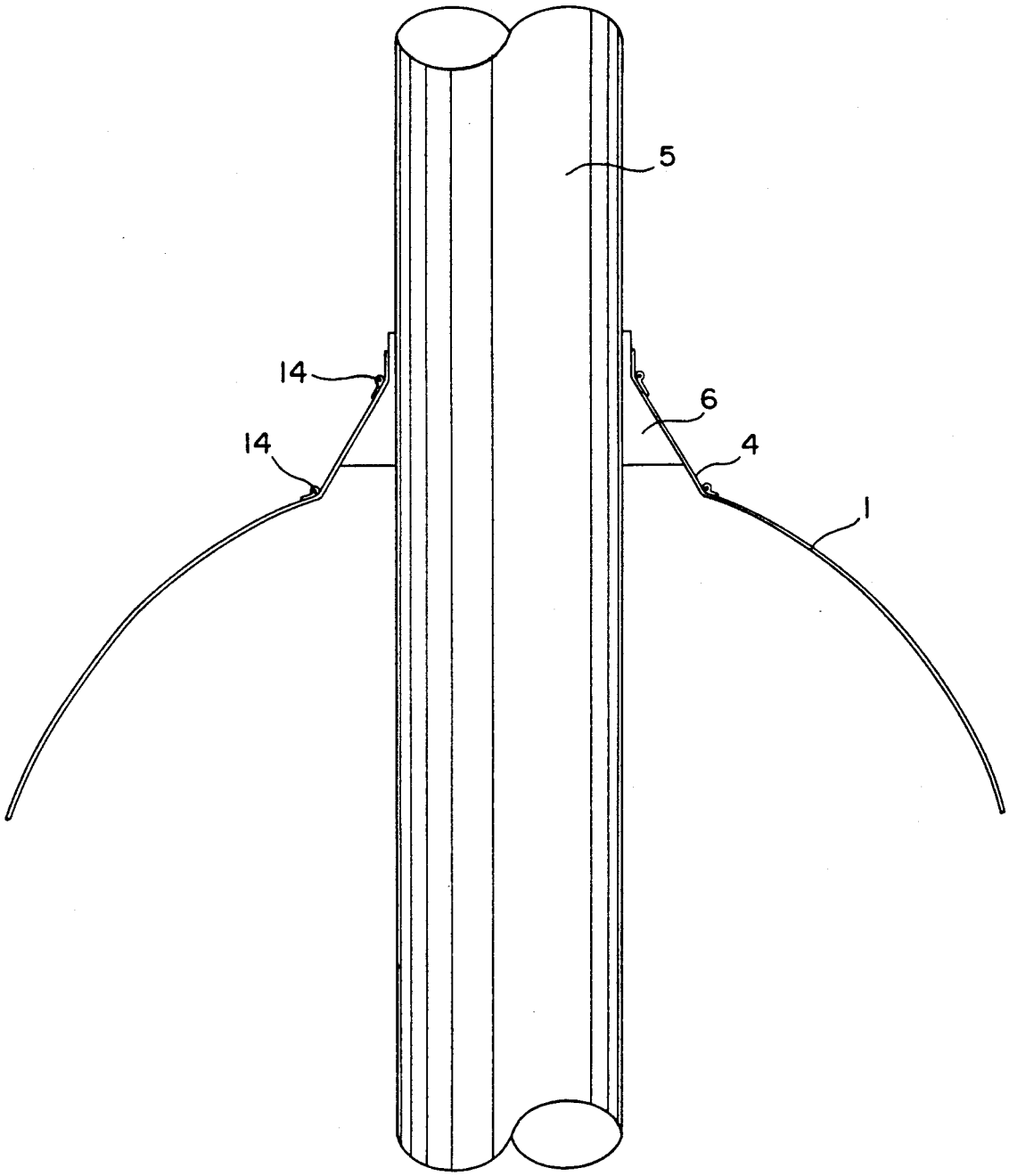
FIG. 5 is a side view of a cross section of the upper portion of the flexible bell, the collar and the spongy, closed-cell, hermetic, waterproof sealing element installed around a tubular member.
Figure 6:
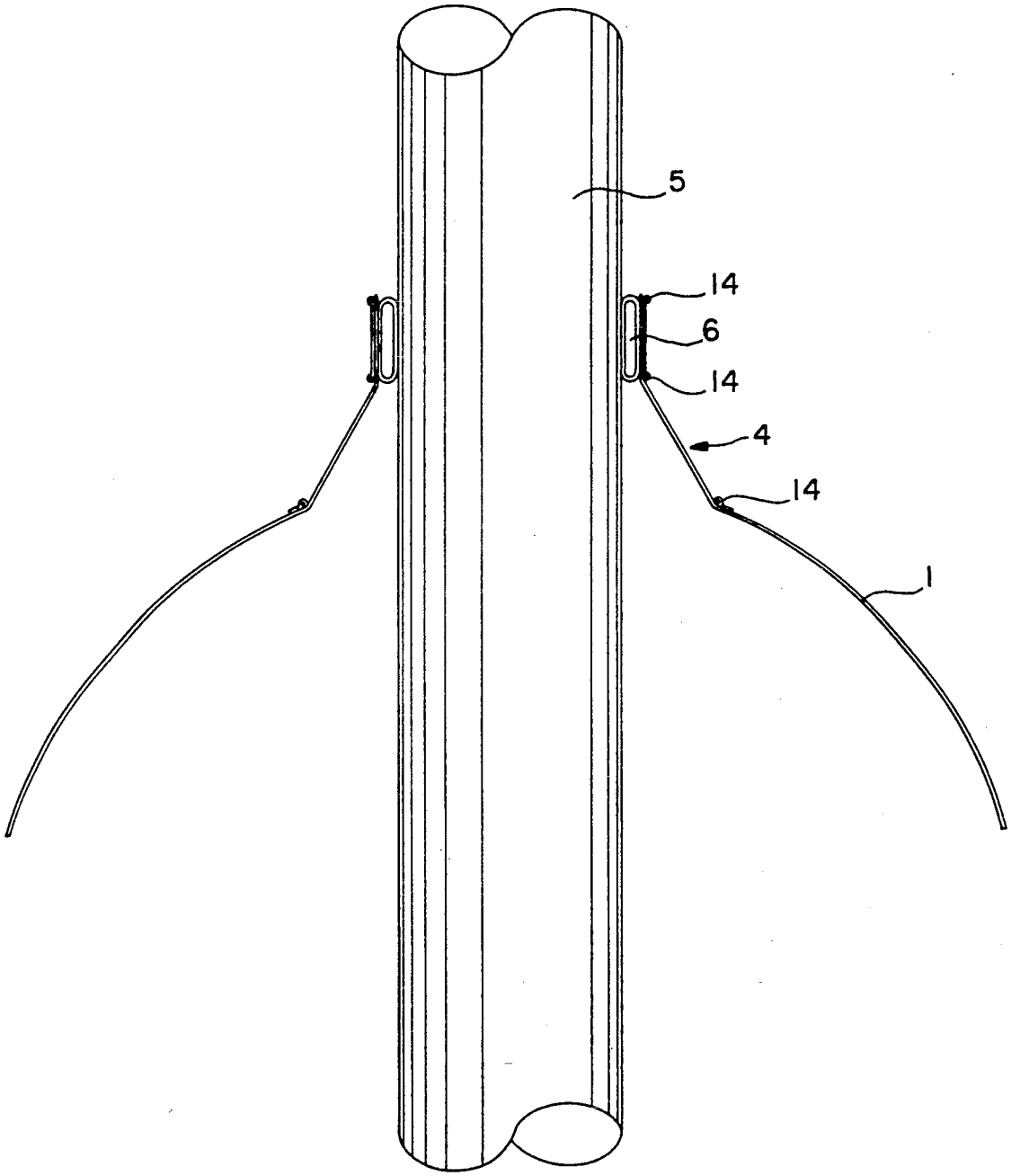
FIG. 6 is a side view showing the upper portion of the flexible bell, the collar and the pneumatic, hermetic, waterproof sealing element installed around a tubular member.

Referring now to FIGS. 5 and 6, different types of sealing elements 6 are depicted in their wedged position. The collar 4 and the sealing elements 6 cooperate to form a seal which prevents air or gas from exiting and/or water from entering the flexible bell 1. In the embodiment portrayed in FIG. 6, the sealing element 6 is of the pneumatic type. Such a pneumatic type sealing element can be constructed of the same material as the flexible bell 1. In the embodiment illustrated in FIG. 5, the sealing element 6 is a spongy material such as a closed cell flexible foam. Suitable closed cell flexible foams include ethylene vinyl acetate, vinyl/nitrile, neoprene and nitrile. A totally hermetic seal is provided by exerting pressure toward the collar 4 and toward the element upon which the flexible bell 1 is mounted. In the case of a pneumatic sealing element 6, the element itself exerts pressure on the collar 4 and the tubular member 5. Alternatively, in the case where the sealing element 6 comprises a closed cell flexible foam, a wedge effect is created by the pressure differential between the inside and the outside of the flexible bell 1.

Figure 12:
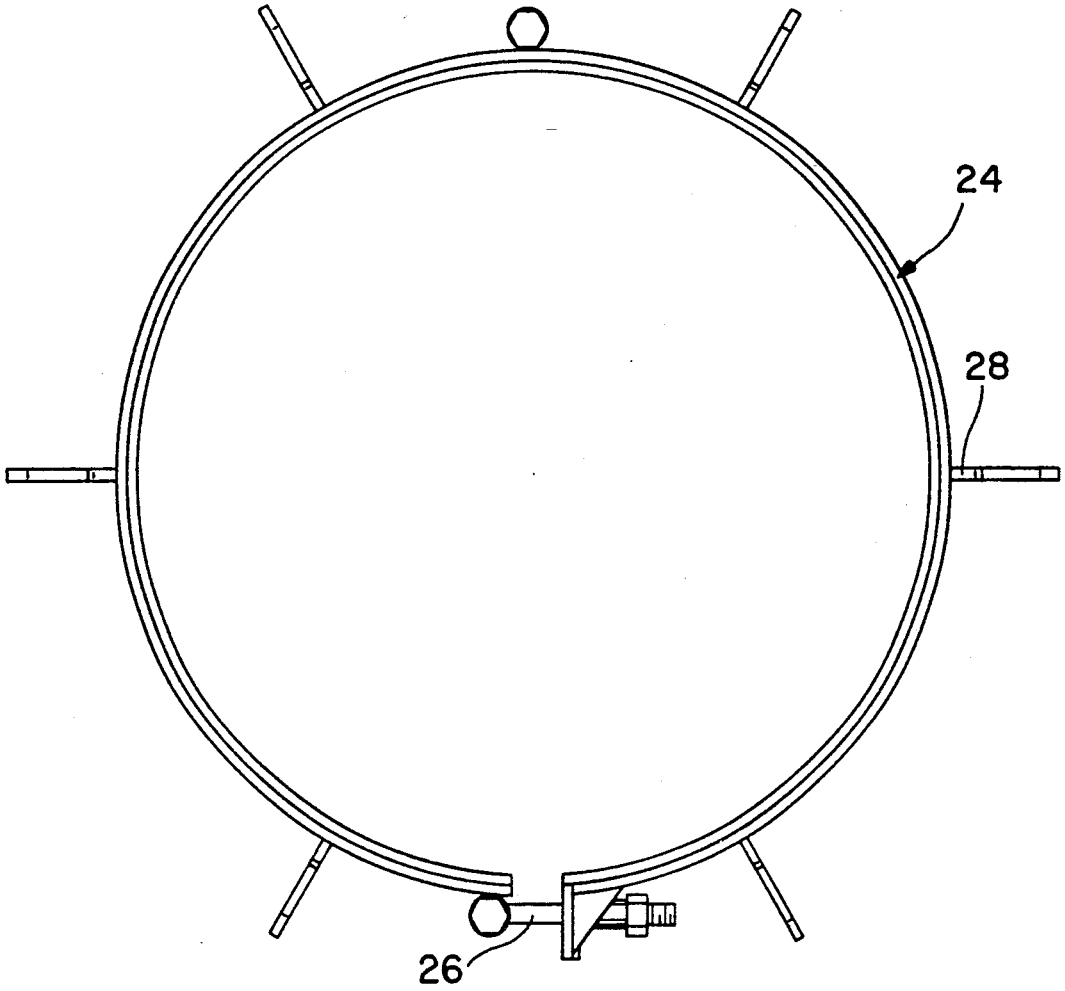
FIG. 12 is a top view of the handling ring of the flexible compartment.
Figure 11:
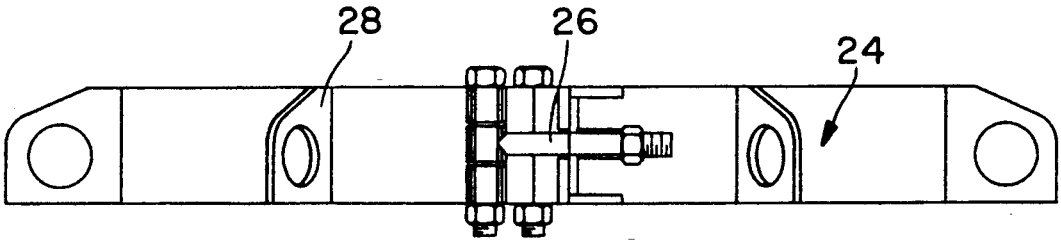
FIG. 11 is a side view of the handling ring of the flexible compartment.

Circumscribing the lower end of the flexible bell 1 is a reinforcement ring 18 composed of the same material as the flexible bell 1. Plates 20 are installed at regularly spaced intervals along the reinforcement ring 18 to receive coupling elements 22 which link the flexible the bell 1 with the platform-brace 7. Another element associated with the flexible bell 1, is an upper handling ring 24 illustrated in FIGS. 11 and 12. A closing system 26 is provided to secure the upper handling ring 24 around a structural element 10. Plates 28 are provided to engage cables or other handling elements used to locate the flexible bell 1 in position. Upper handling ring 24 is installed around the tubular member 10 above the collar 4 to allow for and facilitate the installation of the flexible bell 1 and other components about the tubular member 10.

In addition, communication lines 29 in the form of hoses, tubes, ducts or cables are connected to the flexible bell 1 via connectors 31. Air, gas, fluids, and energy necessary to be supplied to inflate the flexible bell 1 and for the operation of the various accessory systems of the flexible bell 1 are provided from external equipment (not shown) through the communication lines 29.

Of course, it should be understood that the flexible bell 1 can be manufactured in other shapes and sizes, maintaining its characteristics of flexibility and elasticity, so that it may be used on vertical, horizontal, or inclined tubings or structural elements, or at intersections of the same.

Figure 9:
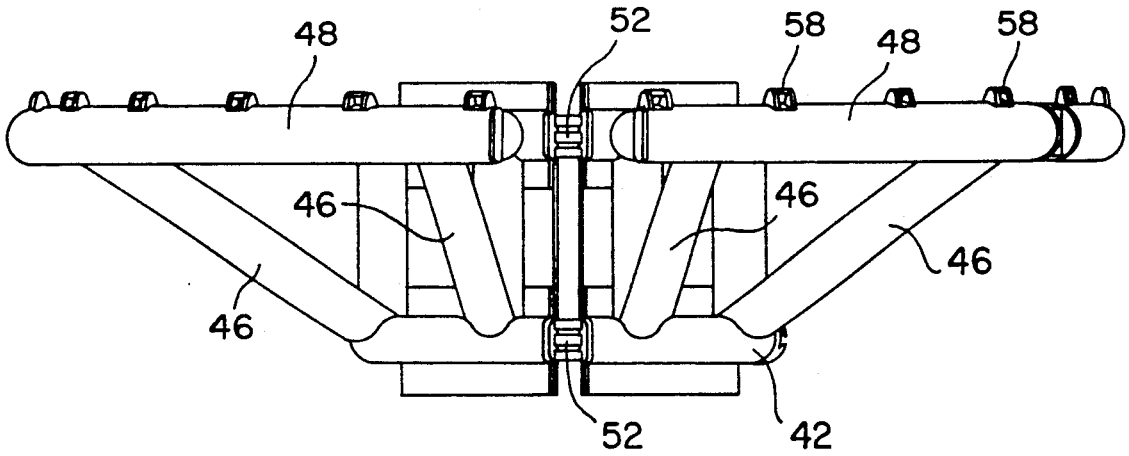
FIG. 9 is a side view of the lower platform-brace of FIG. 7.

Further in keeping with the present invention, to anchor and protect the flexible bell 1 from the turbulence of the ocean, the platform-brace 7 is constructed from a rigid material. Preferably the platform-brace 7 is composed of steel. However, other rigid materials such as carbon fiber reinforced plastic structural members can be employed if desired. As best shown in FIG. 7, in carrying out the invention, the platform-brace 7 is built from modules 30. Each module 30 consists of an inner upper arc member 40 and an inner lower arc member 42 (FIGS. 9, 10) interconnected by braces 45. Extending radially outward from the upper and lower arc members 40 and 42 are horizontal spokes 44 and inclined spokes 46. Each module 30 is fitted with an outer boundary arc member 48 which connects spokes 44, 46. One of the modules 30 is provided with a work surface 50 preferably a rigid grid which bridges from the outer boundary arc member 48 to an inner arc member 40. The work surface 50 provides a surface for a user to stand and rest tools while performing repair or maintenance operations on the tubular member 10.

Further in keeping with the invention, the platform-brace 7 is comprised of several modules 30 which are pivotally interconnected. In the embodiment depicted in FIG. 7, four modules 30 are used to construct the platform-brace 7, therefore, four interconnections are required at the inner arc members. Three of those interconnections are realized by hinges 52 while the fourth is realized by a closing system formed by headstocks 54, screw 56 and left and right lateral nuts 57.

When the modules 30 are interconnected, the boundary members 48 form a discontinuous outer ring 8 wherein selected boundary members 48 are interconnected by inner hinges 52. The boundary members 48 that are interconnected are divided into segments 30 to enable the platform-brace 7 to contract upon contact with a rigid obstacle. Each boundary member 48 contains a number of fasteners 58 which receive coupling elements 60 (FIG. 17) to secure the flexible bell 1 onto the platform-brace 7. Accordingly, the boundary members 48 form a base for the flexible bell 1. It is particularly noteworthy that this configuration can be used in areas containing obstructions because, upon contact with an obstruction, the flexible bell 1 will deform and take the shape of the obstruction. Furthermore, upon contact with an obstruction, the platform-brace 7 will contract (see FIG. 13).

Figure 8:
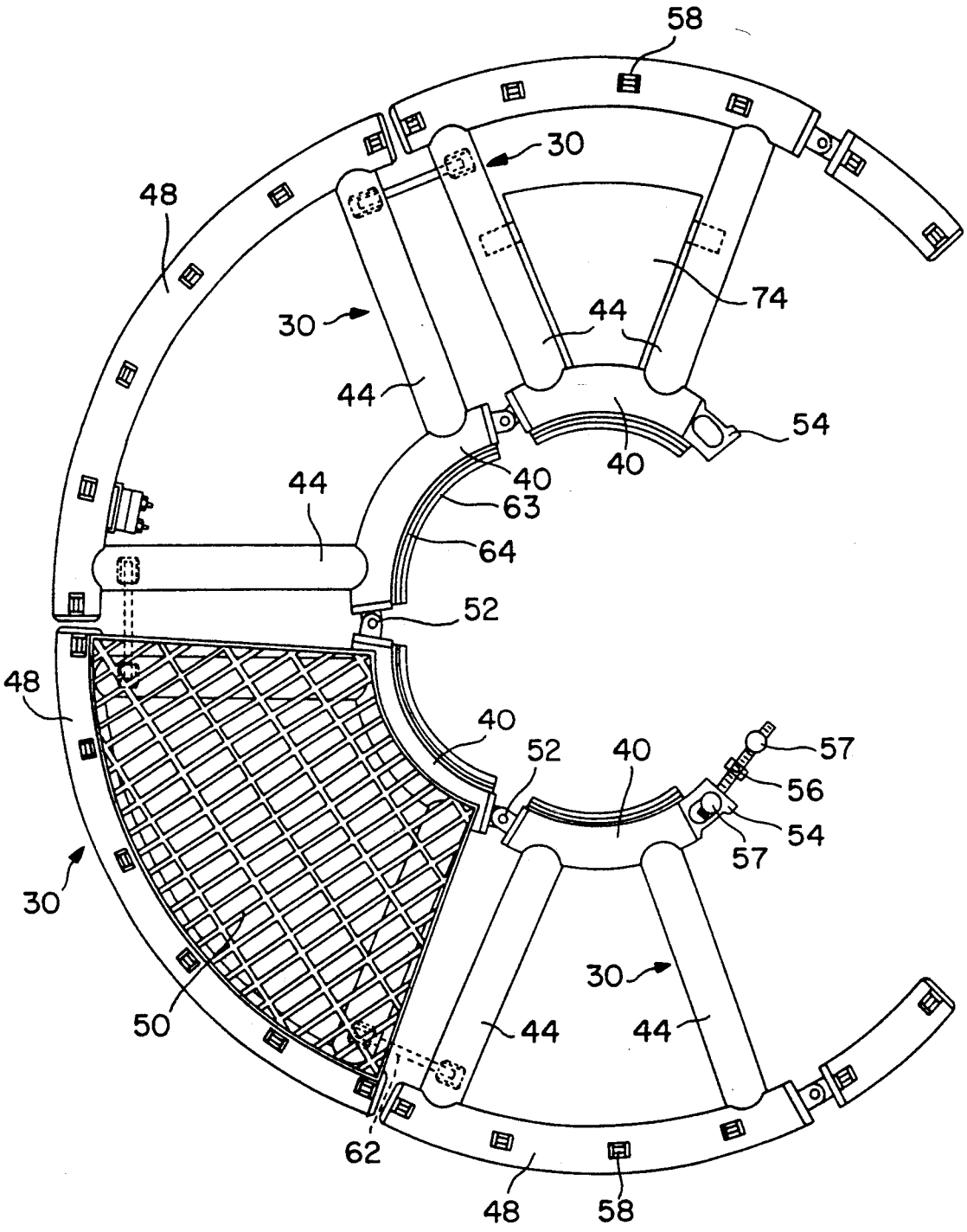
FIG. 8 is a top view of the lower platform-brace of the flexible compartment in its open state.
Figure 10:
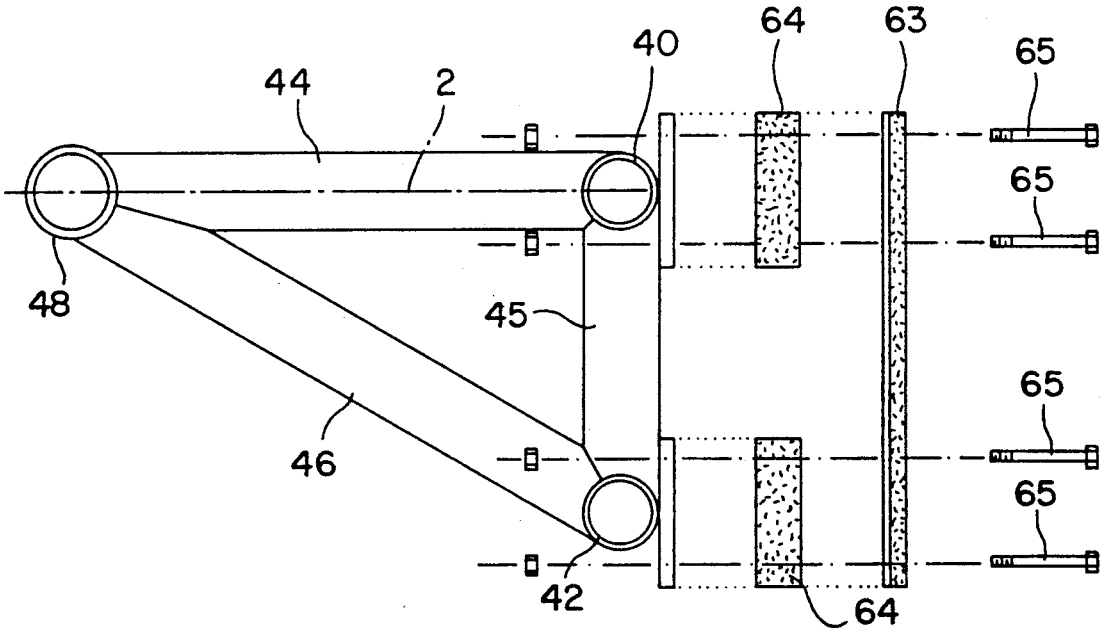
FIG. 10 is a side view of a module of the lower platform-brace showing how the separators and shoes are joined.

To provide for installation of the flexible submersible compartment about the tubular member 5, the platform-brace 7 employs compression members 62 to connect spokes of respective modules. These compression members can be either hydraulic or pneumatic. Referring to FIG. 8, it is apparent that owing to the hinged connection of respective upper and lower arc members 40 and 42 and compression members 62, the platform-brace 7 can be opened and closed thus facilitating installation. As illustrated in FIG. 10, shoes 63 and high density polyurethane separators 64 are affixed to the arc members 40 and 42 in a layered configuration by screws 65. When the platform-brace 7 is in the closed position, the interconnected arc members 40 and 42 form a collar which securely grips the tubular member 5 and supports the platform-brace 7. To accommodate mounting structures of differing cross-sectional areas and/or shapes, the size and shape of the separators 64 and shoes 63 can be adjusted accordingly.

Although the platform-brace 7 and, more particularly, the boundary members 48 are rigidly constructed, boundary members of various shapes can be employed to comport with the geometry of the various obstacles that are encountered. For example, FIG. 14 portrays a platform-brace including arc type boundary members 67 that are specially contoured to align with both a pipe 68 and a platform element 70.

Figure 15:
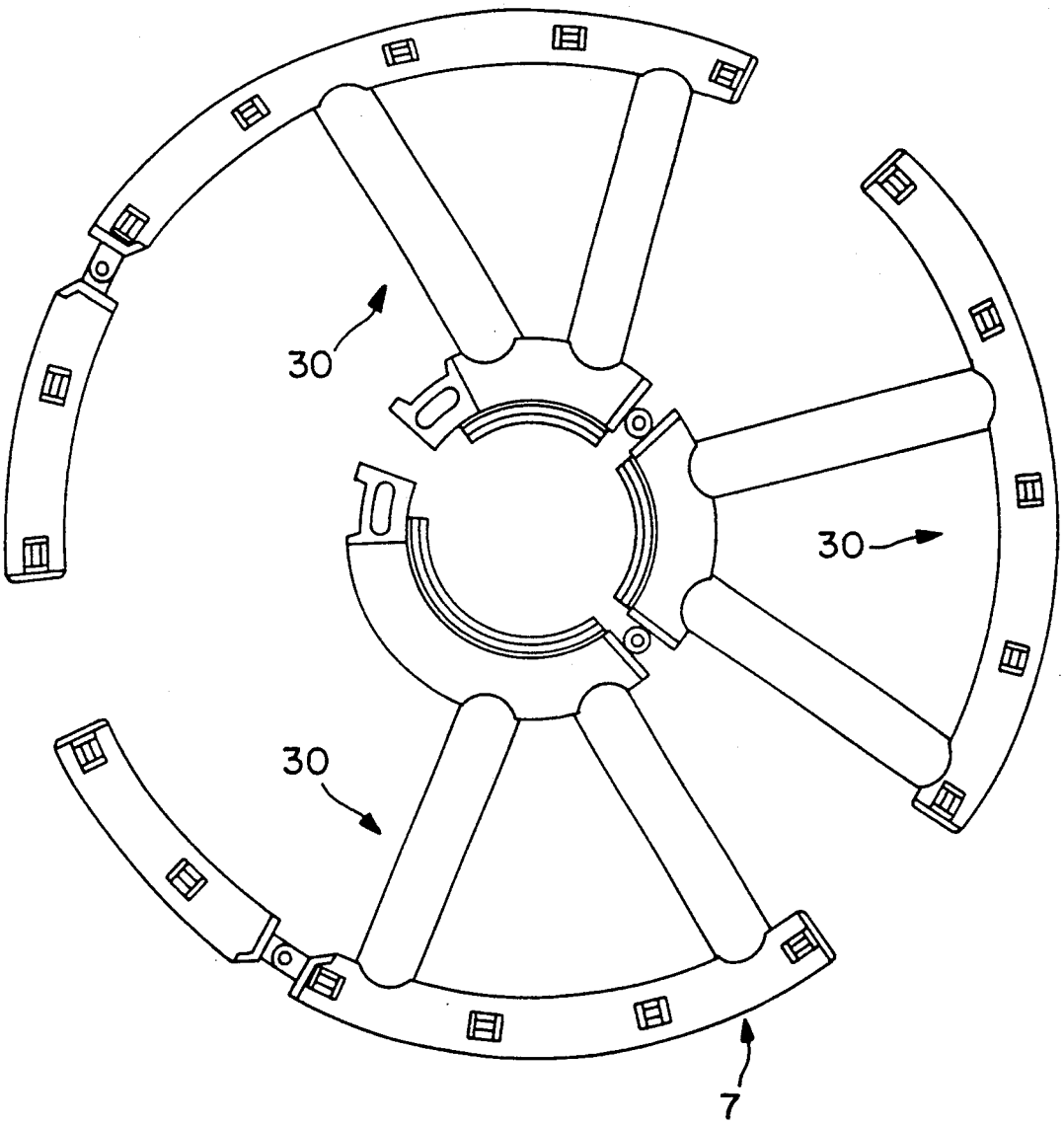
FIG. 15 is a top view of the platform-brace containing three modules.

While the above described platform-brace 7 comprises an interconnection of four modules, the platform-brace need only comprise an interconnection of two or more modules. FIG. 15 illustrates a case where a platform-brace 7 comprises an interconnection of three modules.

Figure 3:
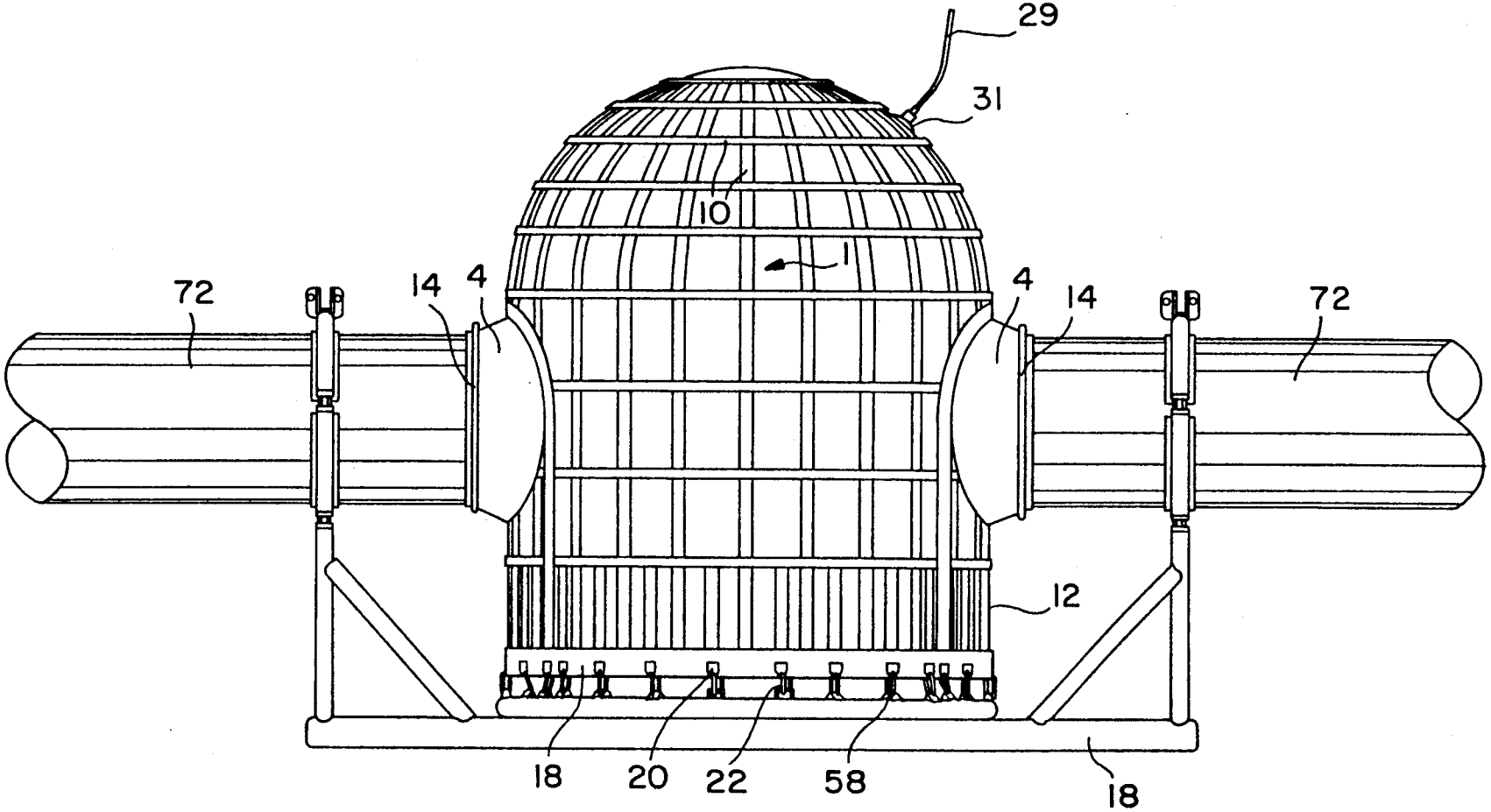
FIG. 3 is a side view of a second embodiment the flexible compartment of the present invention installed around a horizontal tubular member.

According to another embodiment of the invention, referring to FIG. 3, a flexible bell 1 with a closed top portion is provided with a pair of side openings which oppose each other. A collar 4 is attached to each side opening in the same manner as detailed with respect to top opening of the above-described first embodiment of FIG. 1. As shown in FIG. 3, the flexible bell 1 of this embodiment is capable of being installed on a horizontal tubular member 72.

Figure 4:
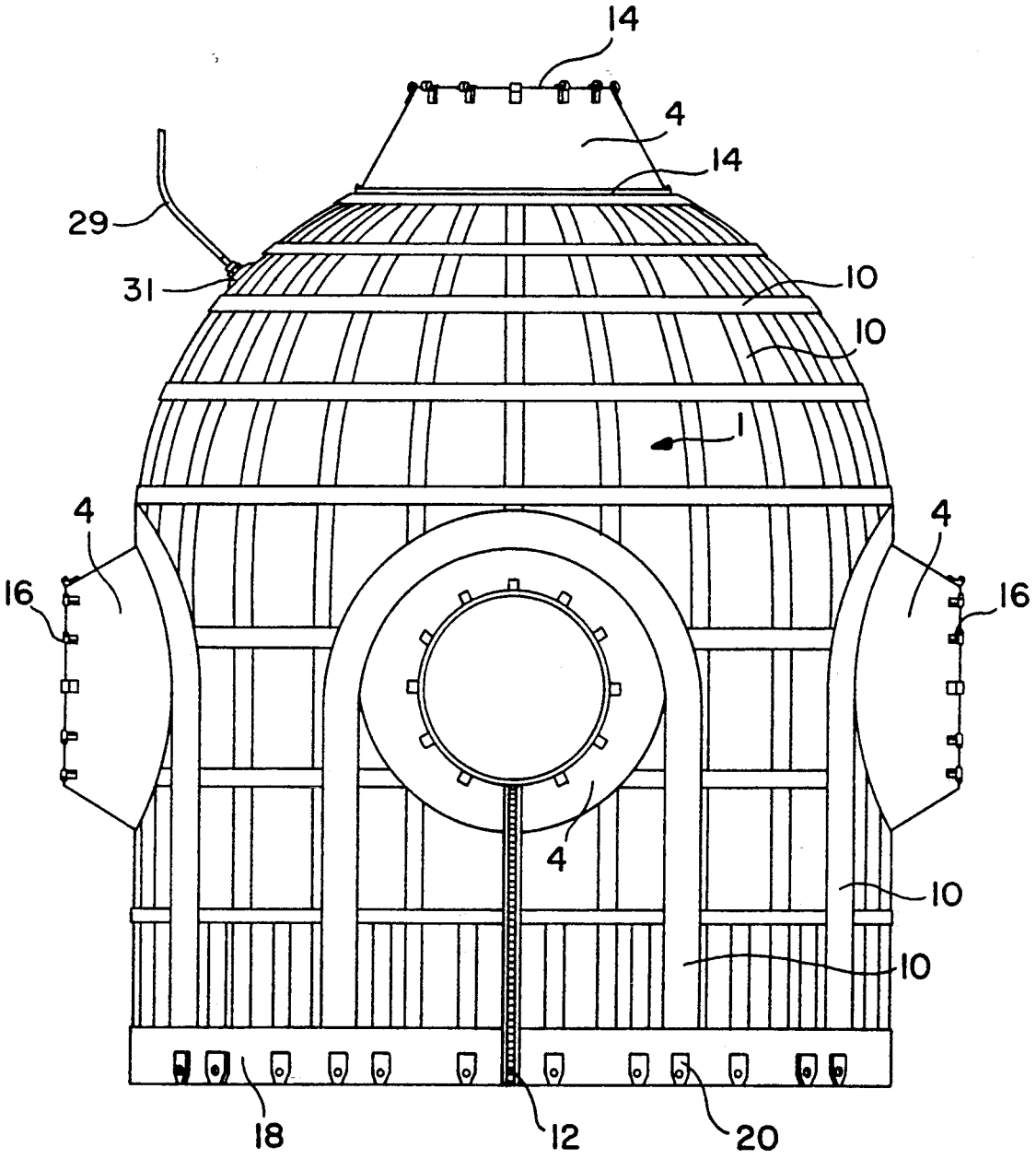
FIG. 4 is a side view of a third embodiment of the flexible compartment which is operable to be installed at an intersection of tubular members.

According to yet another embodiment of the invention, referring to FIG. 4, the top of a flexible bell 1 as well as its sides are provided with openings having collars 4 attached thereto. Otherwise, the construction is the same as the flexible bell of the above-described first embodiment. As shown in FIG. 4, the flexible bell 1 of this embodiment is designed to be installed at the intersection of horizontal and vertical tubular members.

To assist the user, the flexible bell of the instant invention has lighting, smoke removal, and environmental control systems. All control of different functions of this flexible bell 1 are carried out from the surface by the control systems.

Figure 2:
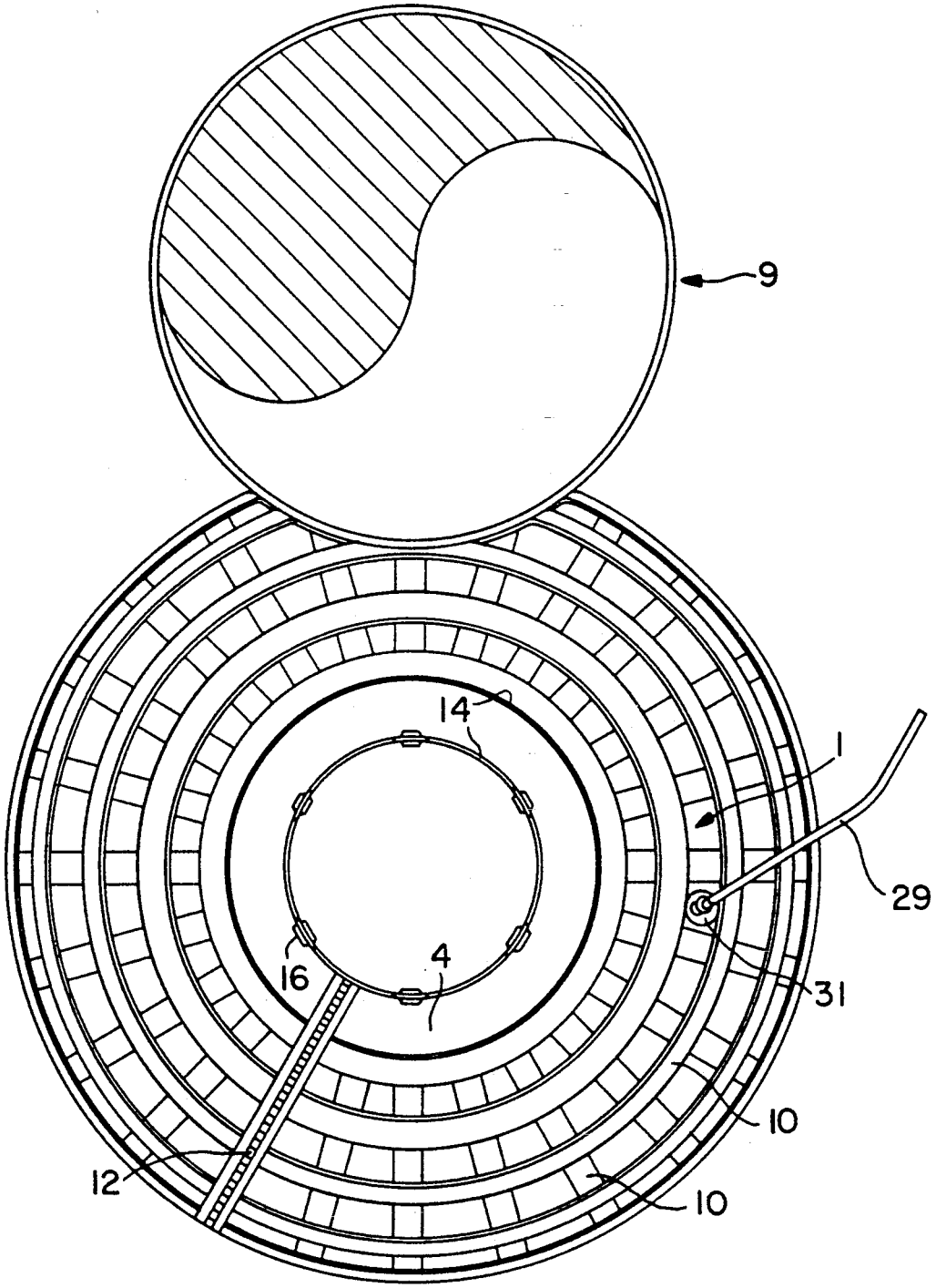
FIG. 2 is a top view of the flexible compartment of the present invention.

Turning to the operation of the invention, a flexible bell 1 is attached to a platform-brace 7 using coupling elements 60. Air is injected into the flexible bell 1 through communication lines 29 from a compressor on the surface to expel trapped water and inflate the flexible bell, to control the interior water level, and to otherwise control the interior environment. FIG. 2 depicts the flexible bell 1 in its fully inflated state in contact with a structural obstacle 10. The flexible bell 1 is accessible through an opening 74 provided in the platform-brace 7. Accordingly, irrespective of the presence of structural obstacles, the flexible, submersible compartment of the instant invention creates a dry, controlled work space for a user to perform operations on a submerged structure. Several embodiments of the invention have been described above. However, numerous modifications will become apparent to the person having ordinary skill in the art which are included within the spirit and scope of the claims that appear below.

We claim:

1. A flexible, submersible compartment which allows a user to perform repairs on submerged structures in dry conditions in the presence of rigid obstacles, said compartment comprising:

a flexible diving bell adapted to be inflated so as to partially enclose a submerged structure, said flexible diving bell having an opening at an upper portion;

a collar attached to said flexible bell at the opening including a seal element for sealing the opening about the submerged structure; and a lower platform-brace attached to said flexible bell comprising a plurality of interconnected modules for anchoring to the structural element, each module including a boundary member wherein the boundary members of the interconnected modules form a discontinuous ring, at least two of the modules including a boundary member having first and second pivotally interconnected segments;

whereby said flexible bell when inflated, and the second segments contract upon contact with a rigid obstacle.

2. A flexible, submersible compartment according to claim 1 wherein said flexible bell includes an hermetic closure mechanism.

3. A flexible, submersible compartment according to claim 2 wherein said hermetic closing mechanism comprises a zipper.

4. A flexible, submersible compartment according to claim 1 further comprising an hermetic sealing element which is lodged between said collar and the structural element.

5. A flexible, submersible compartment according to claim 4 wherein said hermetic sealing element is inflatable and a seal is created by said hermetic sealing element exerting pressure on said flexible bell and on the structural element.

6. A flexible, submersible compartment according to claim 4 wherein the hermetic sealing element comprises a closed cell flexible foam.

7. A flexible, submersible compartment according to claim 1 further comprising a tubular member connected to said flexible bell for injecting gases into said flexible bell to inflate said flexible bell.

8. A flexible, submersible compartment according to claim 1 further comprising metal cables disposed on said collar to limit the deformation of said flexible bell.

9. A flexible, submersible compartment according to claim 1 wherein said flexible bell includes a stress-distributing network comprised of a fiber mesh.

10. A flexible, submersible compartment according to claim 1 further comprising a reinforcement ring circumscribing a lower portion of said flexible bell, said reinforcement ring having a plurality of plates which support coupling elements for attaching said lower platform-brace to said flexible bell.

11. A flexible, submersible compartment according to claim 10 wherein said platform-base has inclined support members.

12. A flexible, submersible compartment according to claim 1 wherein each module has first and second inner arc members and the first inner arc members are interconnected by hinges.

13. A flexible, submersible compartment according to claim 12 wherein each module has shoes affixed to the first and second arc members.

14. A flexible, submersible compartment according to claim 13 wherein each module includes a number of spokes extending from the first and second arc members to the boundary member.

15. A flexible, submersible compartment according to claim 1 further comprising compression mechanisms disposed between and interconnecting the plurality of modules.

16. A flexible, submersible compartment according to claim 1 wherein each boundary member includes a plurality of fasteners for coupling said platform-brace to said flexible bell.

17. A flexible, submersible compartment according to claim 4 wherein said hermetic sealing element is formed by a flexible material which is compressed by the pressure differential between the inside and the outside of said flexible structure.

18. A flexible, submersible compartment according to claim 1 wherein said collar has a conical shape.

19. A flexible, submersible compartment according to claim 1 wherein said collar has a cylindrical shape.

20. A flexible, submersible compartment according to claim 13 wherein said platform-brace includes a module having a rigid supporting surface extending from an inner arc member to the boundary member to provide a work floor inside said flexible bell when said flexible bell is attached to said platform-brace.

21. A flexible, submersible compartment according to claim 12 wherein said platform-brace includes a module having a closing system which firmly secures said platform-brace around the submerged structure.

22. A flexible, submersible compartment which allows a user to perform repairs on submerged structures in the presence of rigid obstacles, said compartment comprising:

a flexible bell having an opening at an upper portion;

a collar attached to said flexible bell at the opening for securing said bell to the submerged structure;

a lower platform-brace attached to said flexible bell comprising a plurality of interconnected modules defining concentric structural borders including an inner border and an outer border, the outer border including first and second arc members, the first arc members having first and second segments pivotally interconnected so that the second segments of the outer border pivot towards the center of the outer border upon contact with a rigid obstacle.

23. A submersible compartment according to claim 22, further comprising compression members disposed between adjacent second arc members.

24. A submersible compartment according to claim 23 wherein said compression members are pneumatic.

25. A submersible compartment according to claim 23 wherein said compression members are hydraulic.

26. A submersible compartment according to claim 27 wherein the inner border includes a latching mechanism.

27. A submersible compartment according to claim 22 wherein the inner border and the outer border are discontinuous rings.

28. A lower platform-brace for a diving bell comprising:

a plurality of modules, each module having:

(a) an arc member, and (b) a support extending from the arc member;

a plurality of pivotal connectors, each pivotal connector interconnecting two modules;

a boundary member connected to each module, at least one of said boundary members being divided into segments wherein each segment is pivotally connected to an adjacent boundary member.

29. A platform-brace according to claim 28 wherein each module includes a first and second arc members and the support extends from one of the first and second arc members.

30. A platform-brace according to claim 28 further comprising a plurality of compression mechanisms, each compression mechanism interconnecting two modules.

31. A flexible, submersible compartment for underwater work in dry conditions which is particularly suited for work on petroleum drilling structures, said compartment comprising:

an inflatable flexible bell of reinforced elastomeric material having an opening defined by a sealing element which can be fitted about a submerged structure to seal the opening; and a rigid platform-brace having a discontinuous outer ring defined by first and second arc members, the first arc members including first and second pivotally interconnected segments and an inner ring adapted to be anchored to a submerged portion of the petroleum drilling structure, said platform-brace being located beneath and attached to said flexible bell;

whereby in the event of contact with a rigid obstacle, the flexible bell adapts to the shape of the obstacle while the second segments contract.

* * * * *

UNITED STATES PATENT AND TRADEMARK OFFICE

CERTIFICATE OF CORRECTION

PATENT NO. : 5,324,140
DATED : June 28, 1994
INVENTOR(S) : Lopez et al.

It is certified that error appears in the above-indentified patent and that said Letters Patent is hereby corrected as shown below:

On the title page:
Between items 76 and 21, insert:

--[30] Foreign Application Priority Data

Mar. 18, 1991 [Mex.] Mexico ..... 24961--.

Signed and Sealed this

Twenty-fifth Day of October, 1994

*Attest:*

*Attesting Officer*

BRUCE LEHMAN

*Commissioner of Patents and Trademarks*